United States Patent [19]

White

[11] 4,249,372

[45] Feb. 10, 1981

[54] CROSS-IGNITION ASSEMBLY FOR COMBUSTION APPARATUS

[75] Inventor: Loren H. White, Scotia, N.Y.

[73] Assignee: General Electric Company, Schenectady, N.Y.

[21] Appl. No.: 57,722

[22] Filed: Jul. 16, 1979

[51] Int. Cl.[3] ..... F02C 7/00

[52] U.S. Cl. ..... 60/39.32; 60/39.37

[58] Field of Search ..... 60/39.32, 39.37, 39.38, 60/39.39, 39.40; 285/169, 302

[56] References Cited

U.S. PATENT DOCUMENTS

| | | | |
|---|---|---|---|
| 2,832,195 | 4/1958 | Weissborn, Jr. | 60/39.37 |
| 3,001,366 | 9/1961 | Shutts | 60/39.82 |
| 3,344,601 | 10/1967 | Mieczkowski, Jr. | 60/39.32 |
| 3,512,808 | 5/1970 | Graham | 285/189 |
| 3,907,334 | 9/1975 | Schera, Jr. | 285/20 |
| 3,939,651 | 2/1976 | Penny | 60/39.32 |

*Primary Examiner*—Jerry W. Myracle

*Attorney, Agent, or Firm*—Jerome C. Squillaro

[57] ABSTRACT

A cross-ignition assembly with a cross-fire tube supported intermediate two adjacent combustors by mounting plates affixed thereto so as to provide a conduit for the flow of hot combustion gases therebetween. The cross-fire tube comprises coaxial telescoping tubular members. A leaf spring retains the outer end of each tubular member in its operative position to effect a cantilever support for each end of the cross-fire tube. A series of cooperating air passageways and channels allow cooling air to flow across the outside and along the inside of the cross-fire tube.

11 Claims, 6 Drawing Figures

CROSS-IGNITION ASSEMBLY FOR COMBUSTION APPARATUS

BACKGROUND OF THE INVENTION

This invention relates to an interconnected combustion system and more particularly to a cross-ignition assembly for interconnecting adjacent combustors in a gas turbine.

A combustion system for a gas turbine commonly includes a number of generally cylindrical combustors disposed about the turbine in an annular arrangement, with each combustor supplying a motive fluid to an arcuate section of a turbine nozzle. It is common practice to interconnect the combustion chambers of adjoining combustors by means of short conduits or "cross-fire tubes" as part of a cross-ignition assembly, the purpose of which is to provide for the ignition of fuel in one chamber from ignited fuel in an adjacent chamber in order to obviate the need for providing a spark plug or the like for each combustor. Additionally, the cross-ignition assembly to some extent also effects an equilization of pressures in adjacent combustors.

A conventional cross-ignition assembly includes cross-fire tubes extending between adjacent combustors. The cross-fire tubes are generally held in place by mounting means which position the opposite ends of the cross-fire tubes in fluid passages formed in the combustion chambers. However, in some such conventional arrangements, the mounting means can inaccurately position the tube ends with respect to the combustion chambers, extending them too far into the combustion gas flow paths therein. This results in damage of cross-fire tubes in the form of end burning. Additionally, cross-fire tubes are often loosely retained in their respective mounting means and are subject to vibration and rotation therein. Typically these mounting means are also loosely affixed to their respective combustor housings or combustion chamber liners, and they are induced to vibrate therein by the oscillation of the retained cross-fire tubes. Such vibration of cross-fire tubes and the mounting means has been found to cause wear and distortion in the cooperating combustor housings and chamber liners, requiring their repair or replacement.

The maximum operating temperature of a cross-fire tube is typically located at its midsection. This is also the most highly stressed structural section of a tube in a conventional cross-ignition assembly wherein the tube is supported at both ends. This combination of temperature and stress makes the cross-fire tube prone to collapse at its midsection. Upon collapse of a cross-fire tube, the combustion gases normally channeled thereby between adjacent combustors may be released to impinge upon the combustor housings. In the past this has lead to overheating and rupture of combustor housings. In an attempt to lower the operating temperature at the midsection of the cross-fire tube, cooling holes or apertures have been provided around the midsection to enable cooling air to enter the tube at that section; however, the cooling obtained by this approach is non-uniform. Additionally, attempts have been made to locate the critical structural sections of cross-fire tubes away from their midsections. This typically has involved use of a cantilever support design wherein the tube members are welded to combustor housings. Such an assembly is disclosed in U.S. Pat. No. 3,001,366 issued Sept. 26, 1961, to L. W. Shutts. However, the welding of a cross-fire tube to a combustor housing gives rise to costly weld repairs, made necessary by thermal cracking or handling damage at the welds, which complicates cross-fire tube replacement.

Furthermore, combustor maintenance in a conventional interconnected combustion system requires that the cross-fire tube ends cooperating with the combustor of interest be withdrawn therefrom. In those systems employing single piece cross-fire tubes, the withdrawl of the tubes from one combustor necessitates their further insertion into the adjacent interconnected combustors. This in turn requires the disassembly of the mounting means in the interconnected combustors in order to obtain access to the combustor of interest, which procedure greatly complicates maintenance efforts.

Accordingly, an object of the present invention is to provide a new and improved cross-ignition assembly for interconnecting adjacent combustors in a gas turbine.

Another object of the present invention is to provide a new and improved cross-ignition assembly including a cross-fire tube especially adapted for facilitating combustion system maintenance.

Another object of the present invention is to provide a new and improved cross-ignition assembly for reducing cross-fire tube end burning and vibration induced wear problems.

Still another object of the present invention is to provide a cross-ignition assembly including improved means for supporting the ends of the cross-fire tube and for cooling the midsection thereof in a manner effective for preventing tube collapse and the attendant damage to combustor housings.

SUMMARY OF THE INVENTION

The above and other objects and advantages are achieved in a cross-ignition assembly comprising a pair of mounting means disposed about aligned fluid passages of adjacent combustors and a pair of coaxial telescoping cross-fire tube members each having its outer end positioned in one of the mounting means and releasably held therein by a leaf spring. Thusly, each of the tube sections is mounted in a cantilever fashion on a respective combustor. The tube members and mounting means are constructed and arranged to define an air passage in the mounting means allowing cooling air to flow along the exterior of the cross-fire tube through a channel defined by a sleeve surrounding the cross-fire tube and extending between the combustors. This flow of air is also caused to flow into the interior of the cross-fire tube through an annular space provided between the telescoping portions of the tube members. The outer one of the telescoping tube members has a reduced cross-section which defines a shoulder adjacent the mentioned annular space and which is effective to alter the direction of the air flow such that it is directed along the interiors of both tube members toward the outer ends of the cross-fire tube. Additionally, each of the springs is of a predetermined length terminating with an end tab which cooperates with an orientation means affixed to each combustor such that the spring tab is received and releasably retained by the orientation means only when it is in a predeterminately oriented position operatively engaged with the cross-fire tube.

BRIEF DESCRIPTION OF THE DRAWINGS

For a better understanding of the invention reference may be had to the acccompanying drawings wherein.

DESCRIPTION OF THE INVENTION

Figure 1:
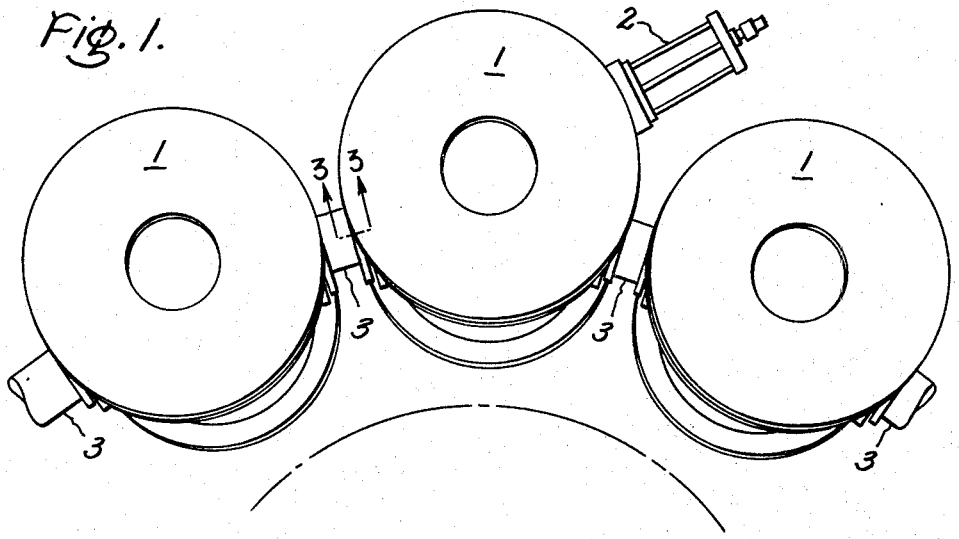
FIG. 1 is an aft transverse view of a segment of an interconnected combustion system employed in a gas turbine.
Figure 2:
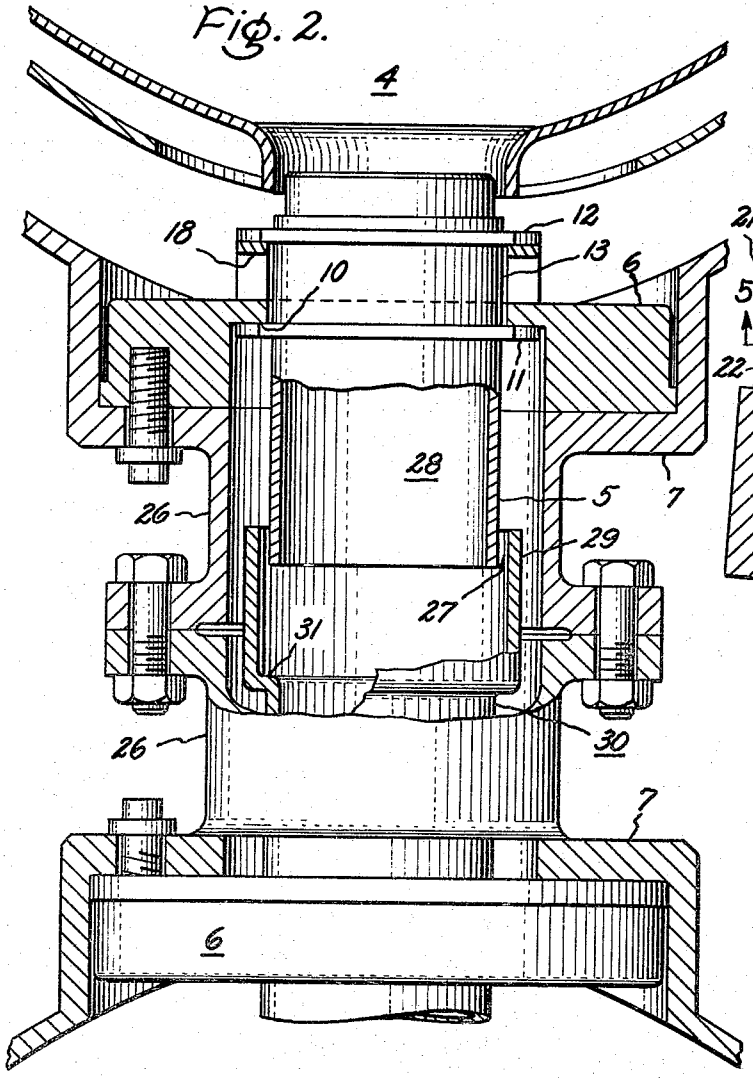
FIG. 2 is a partial sectional view of a cross-ignition assembly constructed in accordance with an embodiment of the invention.

Illustrated in FIG. 1 is a segment of a combustion system comprising three of a usually greater plurality of cylindrical combustors 1 arranged in spaced relation about a turbine not shown. One of the combustors 1 is provided with a spark plug assembly 2 for igniting a mixture of fuel and air in a combustion chamber therein. Cross-ignition assemblies generally designated 3 are positioned between adjacent combustors in alignment with combustion chamber fluid passages 4 contained therein and seen in FIGS. 2 and 3. Cross-fire tubes 5 included in the cross-ignition assemblies 3 have ends positioned in respective combustion chamber fluid passages 4. Thusly, the tubes 5 are adapted to serve as conduits between adjacent combustors to enable hot combustion gases of one combustor to ignite the fuel-air mixture in the combustion chamber of an adjacent combustor 1. This arrangement obviates the need for additional spark assemblies 2.

Both ends of the cross-fire tubes are mounted in the same manner and thus for simplicity of disclosure the mounting of only one end will be described. Accordingly, it is to be understood from FIGS. 2 and 3 that each end of a telescoping cross-fire tube 5 is accurately positioned in a combustion chamber fluid passage 4 through an abutting cooperative relationship with respect to a mounting means 6. By means of this arrangement the over-insertion of the tube end into a combustion gas flow path in the combustion chamber and resultant tube end burning is prevented. The cross-fire tube 5 is also thereby centered in aligned apertures of a combustor housing 7, a flow sleeve 8 and a combustion chamber liner 9 all of which are parts of each combustor 1. Each of the mounting means 6 comprises an annular mounting plate centered about an aperture in one of the combustor housings 7 to which it is securely affixed. Thus, the wear and distortion that might otherwise be caused by the vibration of loosely affixed mounting means is avoided and the accurate positioning of the cross-fire tube by the mounting means 6 is further assured.

The abutting relationship between each cross-fire tube 5 and its respective mounting plate 6 is accomplished by the provision of a counterbore 10 in each mounting plate and a shoulder 11 formed on each end of the cross-fire tube and which is adapted to be seated in one of such counterbores. Each shoulder 11 is disposed in a spaced relation with a second shoulder 12 which together define a spring retaining slot 13.

Figure 4:
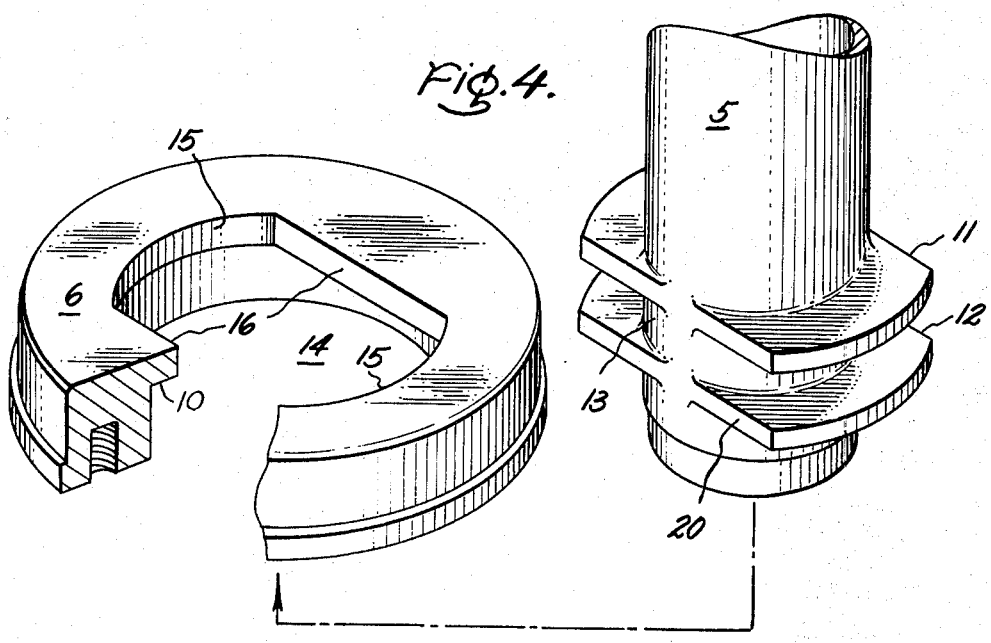
FIG. 4 is a perspective view of a cross-fire tube end and a mounting plate shown prior to assembly.

In a preferred embodiment of this invention depicted in FIG. 4, a central opening 14 in the mounting plate 6 is constructed in the form of diametrically opposed arcs 15 joined by parallel chords 16, and the cross-fire tube shoulders 11 and 12 are similarly configured. Furthermore, the opening 14 in the mounting plate is dimensioned such that during assembly, shoulder 11 can be inserted through its respective mounting plate opening 14, and the end of the cross-fire tube 5 can be rotated 90 degrees about the retaining slot 13 before the tube end is further inserted to place shoulder 11 in its operative position seated in and abutting the bottom of the mounting plate counterbore 10.

Figure 3:
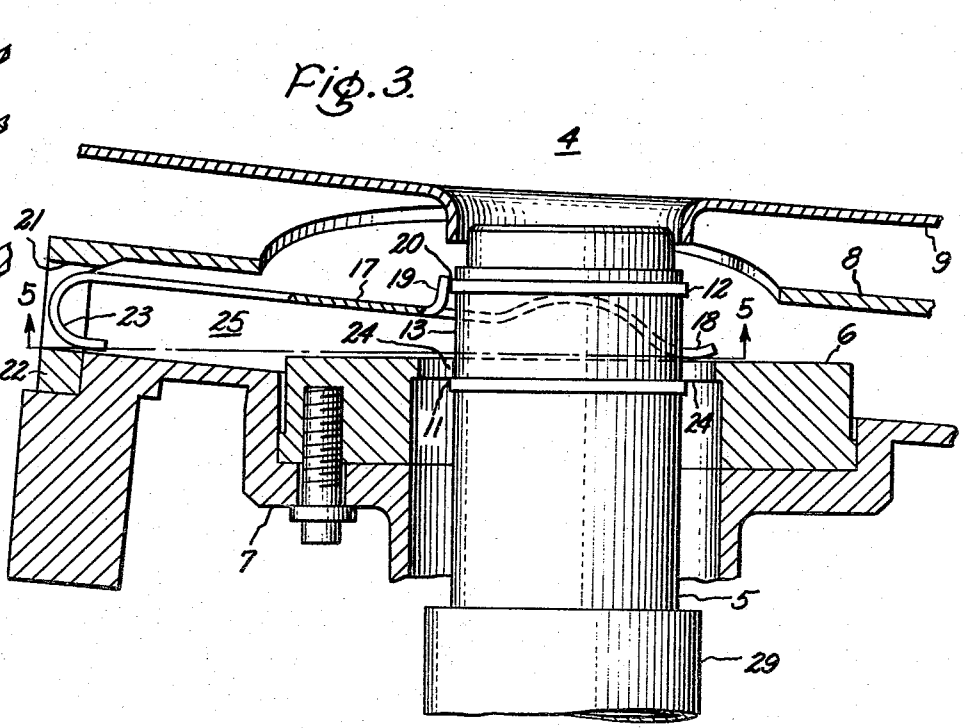
FIG. 3 is a fragmentary sectional view of a portion of the cross-ignition assembly of FIG. 2 taken along line 3—3 in FIG. 1 and looking in the direction of the arrows.
Figure 5:
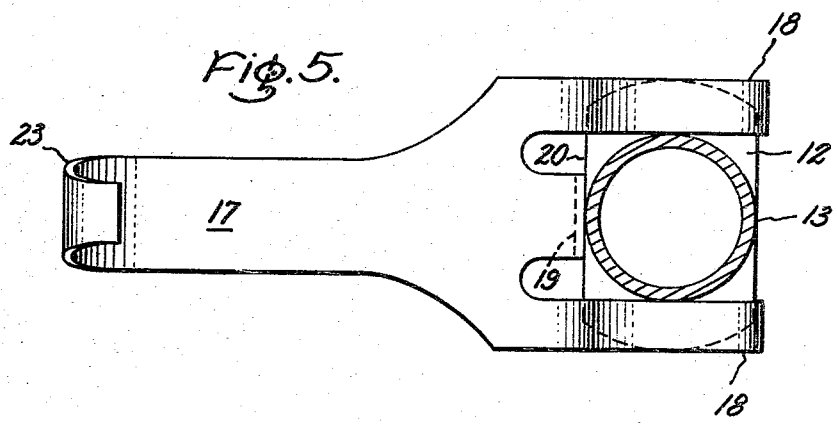
FIG. 5 is a view taken along line 5—5 in FIG. 3, looking in the direction of the arrows and illustrating a leaf spring in supporting engagement with a cross-fire tube section.

As depicted in FIGS. 3 and 5, each cross-fire tube end is retained in its operative position by a leaf spring 17. Each of the retaining leaf springs comprises two substantially parallel prongs 18 straddling the end of the cross-fire tube 5 in the retaining slot 13 formed thereon, and in resilient engagement with both the cross-fire tube shoulder 12 and the associated mounting plate 6. The leaf spring 17 also includes a third prong or detent 19 located intermediate the parallel prongs 18 and cooperating with a flattened portion 20 on the outer shoulder 12 of a retained cross-fire tube end to restrain rotation thereof.

Figure 6:
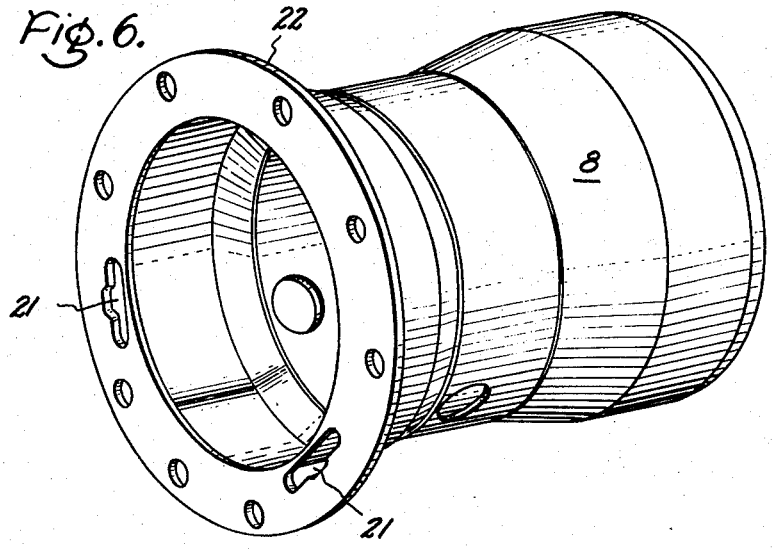
FIG. 6 is a perspective view of a flow sleeve illustrating a flanged end thereof apertured to receive and retain the ends of properly oriented leaf springs.

The leaf spring 17 is inserted into its operative position through an aperture 21 formed in a flange 22 on the combustor flow sleeve 8. As depicted in FIG. 6, the apertures 21 are each complimentarily configured with respect to an end tab 23 on each of the leaf springs 17 to allow the insertion of the respective spring only when it is properly oriented for effectively engaging and retaining a cooperative end of the cross-fire tube 5. Furthermore, each leaf spring 17 is of a predetermined length from the detent 19 to its termination at the end tab 23 such that the end tab 23 is securely seated in its respective aperture 21 in the flange 22 when the leaf spring 17 is operatively positioned.

As best seen in FIGS. 3 and 4, each cross-fire tube inner shoulder 11 cooperates with the central opening 14 in a respective mounting plate 6 to define cooling air passages 24 therebetween. The cooling air passages 24 allow air to flow outwardly from an annular region 25 defined by the combustor housing 7 and the combustion chamber liner 9. Cooperating with the cooling air passages 24 disposed in adjacent interconnected combustors 1 is a bolted sleeve 26 which is an integral part of combustor housing 7. The bolted sleeve 26 is positioned in a spaced relation about the associated cross-fire tube 5 and disposed between the respective mounting plates 6. The bolted sleeve 26 channels air flowing through the cooling air passages 24 across the exterior of the surrounded cross-fire tube 5.

Each cross-fire tube 5 also includes an annular space 27 defined by the exterior of a male cross-fire tube member 28 and the interior of an expanded portion or larger diametered section 29 of a telescopically cooperating female cross-fire tube member 30. In this arrangement, the aforementioned cooling air flows through the annular space 27 and into the interior of the cross-fire tube 5 for the effective cooling thereof. Additionally, the female cross-fire tube member 30 is formed with an internal shoulder 31 at the termination of the annular space 27 to redirect the cooling air flowing therethrough. In this manner the air which would normally flow toward the outer end of the tube member 30 is directed into the interior of the cross-fire tube 5 wherein it is substantially equally distributed toward both ends of the cross-fire tube 5 by a pressure drop in each combustion chamber.

Thusly, the combustors in a combustion system for gas turbines are interconnected by means of cross-fire tubes 5 comprising telescoping tubular sections or members 28 and 30 accurately positioned by the mounting plates 6 with respect to combustion chamber fluid passages 4. Each of the retaining leaf springs 17 resiliently engages the shoulder 12 of one of the cross-fire tube members and the respective mounting plate 6 to effect an independent cantilever support for each of the tubular members comprising the cross-fire tube 5. Additionally, the cooling air flowing from the annular region 25 through the cooling air passage 24 and into the cross-fire tube interior through the annular space 27 provides cooling for both the exterior and the interior of each cross-fire tube.

From the foregoing, it will be seen that the present invention comprises an accurately and securely positioned cross-ignition assembly including coaxially telescoping, cantilever supported tube members which avoids those problems of cross-fire tube end burning and of component wear and collapse attendant the use of conventional designs and facilitates combustion system maintenance.

The above-described embodiment of this invention is intended to be exempletive only and not limiting, and it will be appreciated from the foregoing by those skilled in the art that many substitutions, alterations, and changes may be made to the disclosed structure without departing from the spirit or scope of the invention.

What is claimed as new and desired to be secured by Letters Patent of the United States is:

1. A cross-ignition assembly for combustion apparatus having a pair of adjacent combustors with aligned fluid passages, comprising:

a pair of mounting means each disposed about the fluid passage in one of said combustors;

a cross-fire tube comprising a pair of coaxial telescoping tubular members, each of said tubular members having its outer end extending through one of said mounting means and into one of said adjacent combustors for establishing a conduit therebetween, and each of said tubular members having a first shoulder adjacent its outer end and a second shoulder spaced from said first shoulder engaging one of said mounting means;

and a pair of leaf springs each positioned between the first shoulder of one of said tubular members and a respective one of said mounting means for biasing said second shoulders of said tubular members into engagement with said mounting means and thereby effecting a cantilever support for each end of said cross-fire tube.

2. A cross-ignition assembly as in claim 1, wherein said mounting means each comprise a mounting plate affixed to a respective one of said combustors.

3. A cross-ignition assembly as in claim 1, wherein said leaf springs each comprise a pair of substantially parallel prongs straddling one of said tubular members of said cross-fire tube and in resilient engagement with both the first shoulder thereon and the respective one of said mounting means.

4. A cross-ignition assembly as in claim 3, wherein said leaf springs each comprise a detent located intermediate said parallel prongs and effective to cooperate with a flattened portion of the first shoulder of a respective tubular member to restrain rotation thereof.

5. A cross-ignition assembly as in claim 1, wherein one of said coaxial telescoping tubular members of said cross-fire tube has an end section of substantially greater diameter than the other tubular member to define an annular space therebetween for the flow of cooling air therethrough.

6. A cross-ignition assembly as in claim 5, wherein said one tubular member is provided with an internal annular shoulder spaced from the adjacent end of said inner tubular member to effect an alteration in the direction of the cooling air flow through said annular space.

7. A cross-ignition assembly as in claim 1, wherein said mounting means and said second shoulders on said tubular members cooperate to define cooling air passages therebetween and from said combustors.

8. A cross-ignition assembly as in claim 7, including an air sleeve positioned in spaced relation about said cross-fire tube and disposed between adjacent ones of said mounting means to cause air flowing through said cooling air passages to be channeled across said cross-fire tube.

9. A cross-ignition assembly as in claim 8, wherein said coaxial telescoping tubular members have inner sections of substantially different diameters to define an annular space therebetween effective to enable cooling air channeled by said sleeve to flow therethrough.

10. A cross-ignition assembly as in claim 1, wherein said leaf springs each include an end tab;

and orientation means affixed to each of said combustors receives and releasably retains said end tabs of said leaf springs, each of said orientation means having an aperture oriented to enable receipt of one said end tabs only when the respective spring member is in a predeterminedly oriented position.

11. A cross-ignition assembly as in claim 10, wherein said leaf springs have a predetermined length such that said end tabs thereof are seated securely in said apertures in said orientation means when said spring members are operatively engaged with a respective first shoulder on one of said tubular members of said cross-fire tube.

* * * * *